US010087596B2

(12) United States Patent
Vuyk, Jr. et al.

(10) Patent No.: US 10,087,596 B2
(45) Date of Patent: Oct. 2, 2018

(54) METHOD AND APPARATUS FOR KEEPING FOUNDATIONS FLAT

(71) Applicant: Vuyk Technology Holdings, LLC, Cypress, TX (US)

(72) Inventors: Adrian Vuyk, Jr., Cypress, TX (US); Adrian Vuyk, Sr., Houston, TX (US); Ian Vuyk, Cypress, TX (US)

(73) Assignee: Vuyk Technology Holdings, LLC, Cypress, TX (US)

( * ) Notice: Subject to any disclaimer, the term of this patent is extended or adjusted under 35 U.S.C. 154(b) by 0 days.

(21) Appl. No.: 15/730,633

(22) Filed: Oct. 11, 2017

(65) Prior Publication Data

US 2018/0100282 A1 Apr. 12, 2018

Related U.S. Application Data

(60) Provisional application No. 62/406,946, filed on Oct. 12, 2016, provisional application No. 62/406,950, filed on Oct. 12, 2016.

(51) Int. Cl.

| | |
|---|---|
| ***E02D 27/01*** | (2006.01) |
| ***E02D 27/08*** | (2006.01) |
| ***E01C 23/01*** | (2006.01) |

(52) U.S. Cl.

CPC ..... *E02D 27/01* (2013.01); *E01C 23/01* (2013.01); *E02D 27/08* (2013.01); *E02D 2600/10* (2013.01)

(58) Field of Classification Search

CPC ..... E02D 33/00; E02D 27/01; E02D 27/08; E02D 2600/10; E02D 27/32; E01C 23/01; G01C 5/04

See application file for complete search history.

(56) References Cited

U.S. PATENT DOCUMENTS 4,003,263 A * 1/1977 O'Rourke ..... E02D 1/08 33/1 H
4,073,114 A * 2/1978 Irish ..... E04B 1/4107 52/223.13

(Continued)

FOREIGN PATENT DOCUMENTS

CN 104950921 9/2015

OTHER PUBLICATIONS

Foundation Performance Association Structural Committee, Guidelines for the Evaluation of Foundation Movement for Residential and Other Low Rise Buildings, Apr. 11, 2015.*

(Continued)

*Primary Examiner* — Kyle R Quigley
(74) *Attorney, Agent, or Firm* — Hogan Lovells US LLP

(57) ABSTRACT

Embodiments of methods and apparatuses to measure a concrete foundation from within the concrete in order to maintain the foundation in a controlled flat condition over time we disclosed. A method, for example, may include placing a conduit network inside forms of a concrete foundation, documenting the conduit network in X and Y coordinate system, pouring the concrete foundation with the conduit network inside the concrete in generally the same position, passing an elevation measuring sensor through the conduit network to record a baseline elevation of the conduit and using this baseline for relative comparisons in the future. An embodiment of a method also may include using the relative change in the conduit elevation to predict the relative risk of a repair and financial losses and using the relative change in the conduit elevation to assist in the proper repair and maintenance of the foundation.

26 Claims, 12 Drawing Sheets

(56) References Cited

U.S. PATENT DOCUMENTS

| | | | | |
|---|---|---|---|---|
| 4,137,527 | A | 1/1979 | Tennehouse et al. | |
| 4,231,163 | A | 11/1980 | Turloff | |
| 4,673,315 | A * | 6/1987 | Shaw | E02D 35/00 405/229 |
| 5,337,613 | A | 8/1994 | Kovari | |
| 5,367,782 | A | 11/1994 | Izumitani | |
| 2005/0072067 | A1 | 4/2005 | Wobben | |
| 2010/0006161 | A1* | 1/2010 | Rothleitner | E04G 21/30 137/550 |
| 2010/0095603 | A1 | 4/2010 | Defilipp | |
| 2011/0203370 | A1* | 8/2011 | Argov | E03F 7/12 73/438 |
| 2011/0238452 | A1 | 9/2011 | Ziade et al. | |
| 2011/0295523 | A1 | 12/2011 | Hovhanessian et al. | |
| 2015/0276702 | A1* | 10/2015 | England | G01N 33/383 374/4 |

OTHER PUBLICATIONS

Ronald Wyllys, University of Texas at Austin, Using Regression to Estimate and Predict, Jan. 15, 2003.*

Sumitomo Forestry Co., Introducing a Precast Concrete Foundation Construction Method, Apr. 23, 2013.*

Lindeburg, Michael, PE, Mechanical Engineering Reference Manual for the PE Exam, Thirteenth Edition, PPI, Belmont, CA, 2013.

International Search Report and Written Opinion for PCT/US2017/056217, dated Jan. 8, 2018.

International Search Report and Written Opinion for PCT/US2017/056207, dated Jan. 2, 2018.

Mechanical Engineering Reference Manual for the PE Exam, Thirteenth Edition by Michael Lindeburg, PE., Belmont, CA, including pp. 1369-1374.

* cited by examiner

| CONDUIT 7 | PAYOUT 27 | PRESSURE(P) | DATUM DISTANCE 18 (X) | DATUM DISTANCE 17 (Y) | DATUM DEPTH 19 (Z) |
|---|---|---|---|---|---|
| LATERAL 2 | 12.0 FT | −0.0411 PSI | 6.12 FT | 9.34 FT | −1.139 IN |
| LATERAL 2 | 13.0 FT | −0.0409 PSI | 6.15 FT | 10.29 FT | −1.133 IN |
| LATERAL 2 | 14.0 FT | −0.0391 PSI | 6.13 FT | 11.3 FT | −1.083 IN |
| LATERAL 2 | 15.0 FT | −0.0403 PSI | 6.21 FT | 12.34 FT | −1.117 IN |
| LATERAL 2 | 16.0 FT | −0.0407 PSI | 6.19 FT | 13.29 FT | −1.128 IN |

FIG. 9A

| CONDUIT 7 | PAYOUT 27 | PRESSURE(P) | DATUM DISTANCE 18 (X) | DATUM DISTANCE 17 (Y) | DATUM DEPTH 19 (Z) | ELEVATION CHANGE SINCE TIME=0 |
|---|---|---|---|---|---|---|
| LATERAL 2 | 12.0 FT | −0.0415 PSI | 6.12 FT | 9.34 FT | −1.150 IN | −0.011 IN |
| LATERAL 2 | 13.0 FT | −0.0402 PSI | 6.15 FT | 10.29 FT | −1.114 IN | 0.019 IN |
| LATERAL 2 | 14.0 FT | −0.0391 PSI | 6.13 FT | 11.3 FT | −1.083 IN | 0.000 IN |
| LATERAL 2 | 15.0 FT | −0.0378 PSI | 6.21 FT | 12.34 FT | −1.047 IN | 0.069 IN |
| LATERAL 2 | 16.0 FT | −0.0342 PSI | 6.19 FT | 13.29 FT | −0.948 IN | 0.180 IN |

FIG. 9B

| CONDUIT 7 | PAYOUT 27 | PRESSURE(P) | DATUM DISTANCE 18 (X) | DATUM DISTANCE 17 (Y) | DATUM DEPTH 19 (Z) | CHANGE SINCE TIME=0 | CHANGE SINCE TIME=2.1 |
|---|---|---|---|---|---|---|---|
| LATERAL 2 | 12.0 FT | −0.0411 PSI | 6.12 FT | 9.34 FT | −1.139 IN | 0.000 IN | 0.011 IN |
| LATERAL 2 | 13.0 FT | −0.0398 PSI | 6.15 FT | 10.29 FT | −1.103 IN | 0.030 IN | 0.011 IN |
| LATERAL 2 | 14.0 FT | −0.0373 PSI | 6.13 FT | 11.3 FT | −1.033 IN | 0.050 IN | 0.050 IN |
| LATERAL 2 | 15.0 FT | −0.0344 PSI | 6.21 FT | 12.34 FT | −0.953 IN | 0.163 IN | 0.094 IN |
| LATERAL 2 | 16.0 FT | −0.0401 PSI | 6.19 FT | 13.29 FT | −1.111 IN | 0.017 IN | −0.163 IN |

FIG. 9C

METHOD AND APPARATUS FOR KEEPING FOUNDATIONS FLAT

CROSS-REFERENCE TO RELATED APPLICATIONS

This application is related to, and claims the benefit of, U.S. Provisional Application No. 62/406,946 titled METHOD AND APPARATUS FOR KEEPING FOUNDATIONS FLAT, filed Oct. 12, 2016, and U.S. Provisional Application No. 62/406,950, titled SYSTEMS AND METHODS FOR DATA TRACKING TO ENHANCE FOUNDATIONS, filed Oct. 12, 2016, each of which is incorporated herein in its entirety by reference.

BACKGROUND OF THE INVENTION

Field of the Invention

The present disclosure generally relates to method for maintaining a flat foundation upon which a structure is built and an apparatus for monitoring movement of the aforementioned foundation to facilitate the return of the foundation to the initial flat condition.

Description of the Related Art

In the construction industry, there has been significant effort over time to reduce the impact that soil movement has on the foundation and the edifice that is constructed upon it. Even though foundations have been built for centuries, a foundation that remains flat over long periods of time has been expensive to achieve and eludes most buyers. During construction, the soils with the desired properties are often not found on the construction site and are thus imported. Even if the right soils are imported, they often are not uniformly deposited and compacted. Simple options like building an elevated foundation on cinder blocks or bell bottom piers and "shimming" the home from within a crawlspace are indeed practiced but don't offer the pricing and design benefits of a conventional slab on grade foundation. In short, a home foundation that stays flat forever has eluded many in the industry.

Technologies to repair cracked foundations are well known in the construction industry and offer varying degrees of success and economic viability. The foundation repair industry is known for corrupt practices and companies that start up, offer lifetime guarantees, and then close down leaving the homeowner in a worse position as future repairs have to work around equipment that is now buried under the foundation. There is currently no credible way to determine if a foundation built on soil which is suspected of movement has actually moved relative to its initial "as built" condition. Elevation maps taken of a building can be misleading because the soil changes seasonally and the flooring surfaces rarely remain flat over the useful life span of a building. It is difficult to be certain about the presence or absence of modifications to the structure. This results in seasonal fluctuations in foundation heave or sag that can be hard to separate from a true permanent deformation. Soils of varying properties that are native or brought in during the construction process likewise create a problem that has to be dealt with by the engineer designing the foundation, the company constructing on said soils, the developer who bought the land, the insurance company who may have an insurance policy against foundation movement, and all property owners.

SUMMARY OF THE INVENTION

Embodiments of the present disclosure generally relate to a method and apparatus for foundation construction. In one embodiment, an apparatus is cast generally within the concrete foundation. The apparatus contains: an entry point to the concrete foundation, a conduit network connected to the entry point and disposed within the concrete used to establish a determinate three dimensional data set representing the path of the conduit and thus define the foundation geometry, and a means to record the data set for future use. The apparatus may also include a strengthening member used to offset the weakening potential of the conduit.

In one embodiment, the current disclosure relates to the method of recording baseline elevation readings of the foundation through the aforementioned conduit network after the concrete is poured to establish a baseline elevation map, taking additional elevation readings through the aforementioned conduit at a new point in time; calculating the relative movement of the foundation along the trajectory, and determining the relative foundation elevation change and the time rate of change.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIGS. 9A-C depict a simplified schematic diagram of the present disclosure of a foundation measuring device, system, and the automation thereof.

DETAILED DESCRIPTION

Figure 1:
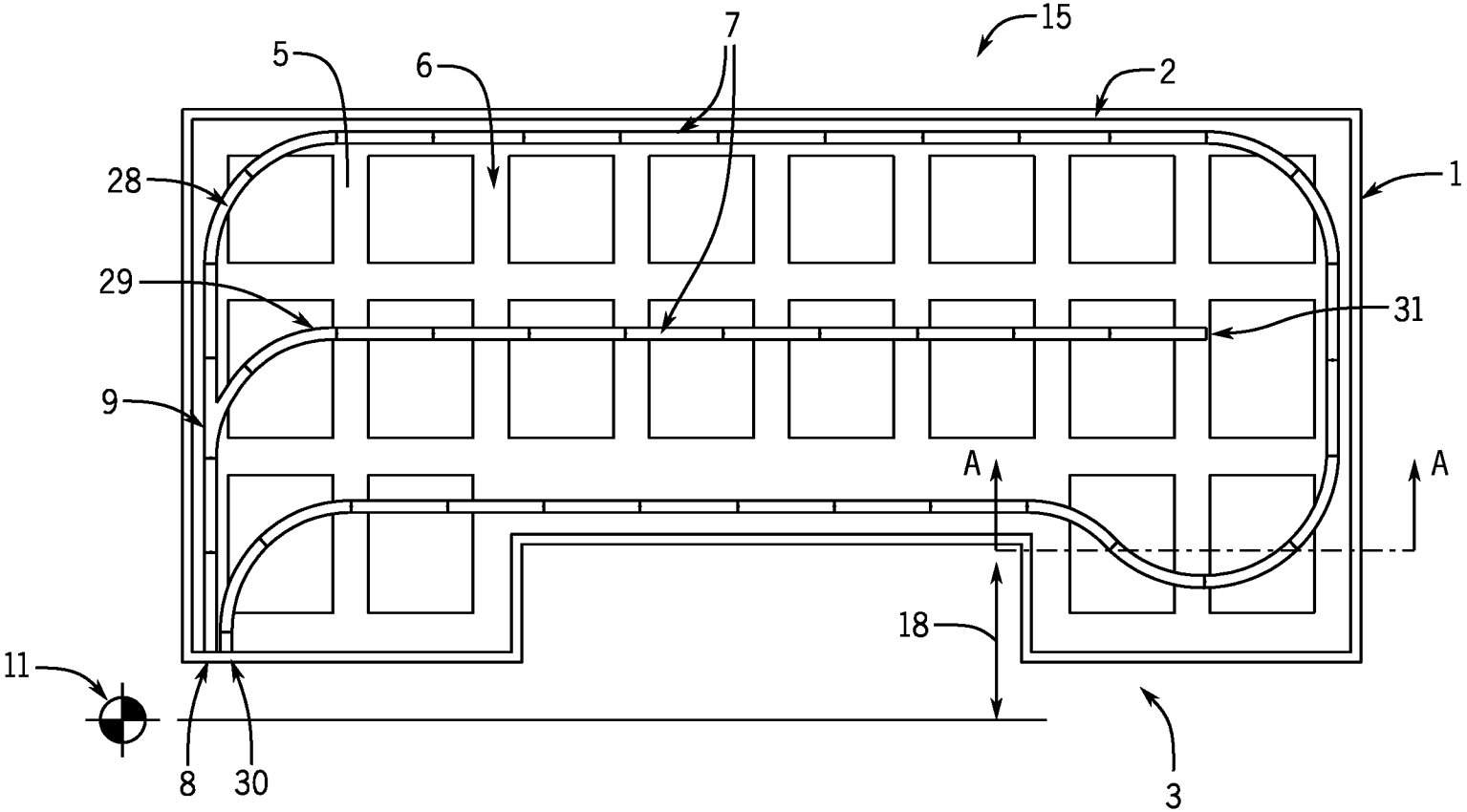
FIG. 1 is a plan view of a foundation with conduit installed prior to concrete pouring, according to one embodiment of the present disclosure.

The method and apparatus for keeping foundations flat of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 is a plan view of a foundation 3 with conduit 7 installed prior to concrete 4 (not shown) pouring, according to one embodiment of the present disclosure. Although a slab-on-grade foundation 3 is depicted here, the foundation technology disclosed in the present disclosure is understood to include any foundation 3 that has a structure that can be identified as separate from the virgin native soil 20 (not shown) as having properties designed to enhance the future strength of a structure placed upon it. This can include a temporary structure like a crane on matting boards, or a more permanent structure such as a home or similar structure on a pier and beam style foundation, a mobile home on concrete blocks, a formed basement foundation or any structure that would ordinarily be designed by one skilled in the art of foundation design or construction and with the purpose of carrying a load on soil. The foundation has forms 1 which create a temporary shape that determine the perimeter 2 of the foundation 3 when concrete 4 is poured. Within the perimeter 2 are usually found several trenches 5 which will form beams 6 when the concrete 4 is poured.

At a convenient point in time, preferably after the conventional foundation preparatory work like excavation, plumbing, electrical, cable installation is completed but prior to the solidification of the concrete, one or more conduit 7 is placed generally inside the perimeter 2 of the foundation 3 that can have one or more points of entry 8 from the exterior of the final foundation 3 to the void filled with the concrete 4. The at least one conduit 7 may have one or more junctions 9 that allow the conduit 7 to extend under more than just one generally straight path of the surface 10 of the foundation 3 for the purpose of generating a plurality of topographical data 12 (not shown) relative to one or more datum 1. It is understood that many variations of the conduit design may exist including, but not limited to, the alteration of conduit 7 by looping the conduit back and forth to eliminate the junctions 9. There is no expectation that the conduit should be placed above or below or in any position relative to any of the plumbing, electrical, rebar, or cables that may be placed inside of the foundation structure although it may be preferred from a service standpoint to do so at the final stages of foundation preparation. The practice of insitu bending of conduit 7 as needed to achieve the conduit path 15 needed is common in the industry. Practices like placement of springs or sand or cables on the ID of PVC pipe during bending to prevent collapse or deformation during the bending while elevating the conduit to elevated temperatures for easier bending is well known in the public domain by those skilled in the art of placing piping. Alternately, the conduit 7 may be pre-bent and assembled on site as is common in the plumbing industry. Further, the conduit may be a flexible coil or tubing that is placed in the foundation by unspooling a length of tubing as required.

Alternatively, although perhaps more challenging, it is practical to eliminate the need to place the conduit 7 inside of the foundation 3 prior to foundation pouring or even to have a physical conduit 7 present in the foundation 3 at all. One skilled in the art of directional drilling could reduce the size of existing drilling tools and drill one or more generally uniform cavities into and through the foundation. Drilling the conduit through the foundation using this type of approach or even perforating, extended reach drilling or gun drilling type technologies would yield a conduit path 15 in the foundation 3 without actually placing a conduit 7 in the foundation 3 prior to full solidification of the concrete 4. Although this is a significantly more expensive approach, this could be an alternative that would yield similar benefits of analyzing the deformation of a foundation 3 over time. To make this technique practical, the drilling of the conduit path 15 would have to be completed proximate in time to the pouring of the foundation to remain relevant to this disclosure. Other techniques for analyzing foundation deformation after the apparent onset of foundation 3 deformation exist in the prior art and are not included in the scope of the present disclosure. It should be noted that although the preferred embodiment in this disclosure is a conduit 7 that is made of flexible PVC or similar rigid plastic and has properties that make the conduit 3 very reliable in long term exposure to concrete and sunlight, it is possible to select other materials or a conduit that is very rigid to reduce the variation in the conduit path. Further it is possible that the conduit 7 be partially or completely removed at some point. For example, the conduit could be solid or hollow paper which could then be drilled or jetted out after the concrete 4 has fully set thus leaving no evidence that a conduit pipe was ever present although an ID is still present. Therefore, a foundation that has no physically identifiable conduit membrane or wall but does contain a conduit path would fit within the scope of the present disclosure.

In the preferred embodiment of the present disclosure, the conduit 7 has a point of entry 8 and may have a conduit terminus that is open or closed. In the event that the conduit 7 is open to the perimeter 2 it will be termed an open conduit terminus 30 and in the event that it terminates within the concrete it will be termed a closed concrete terminus 31. It should be noted that the point of entry 8 and the open conduit terminus 30 can be interchangeable. In other words, the measuring equipment to be discussed can enter through the open conduit terminus 30 which would then be considered a point of entry 8.

Figure 2:
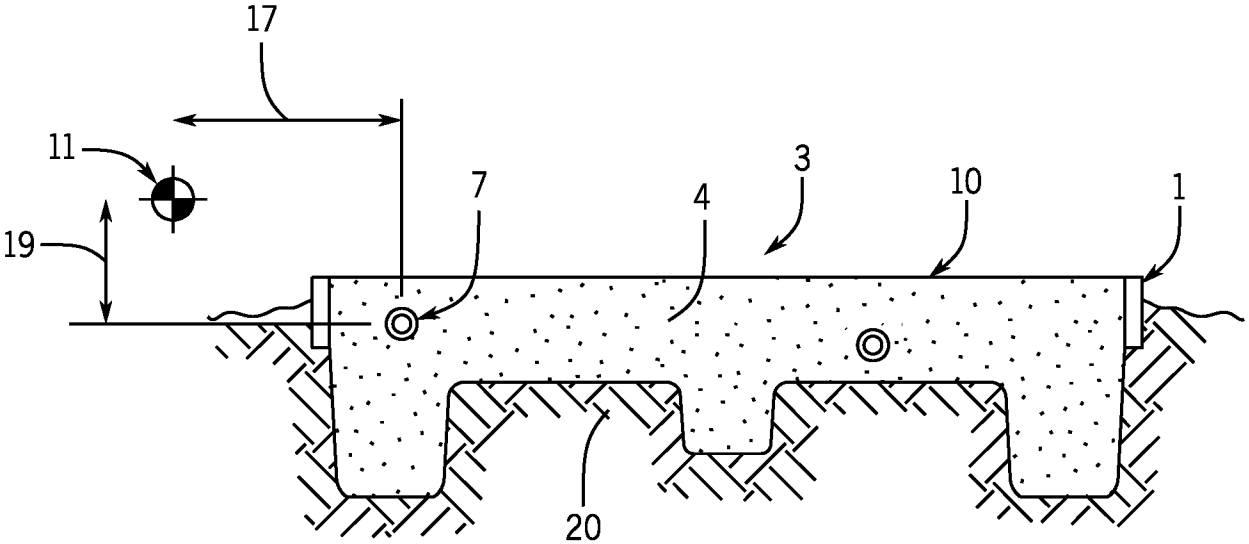
FIG. 2 is a simplified sectional view of conduit installed in the foundation after pouring concrete, according to another embodiment of the present disclosure.

FIG. 2 depicts a simplified sectional view of a portion of the foundation 3 of the present disclosure after pouring concrete 4. This section (or plane) is taken at a datum distance 18 relative to a coordinate frame of reference that intersects the datum. The conduit 7 is generally disposed inside the foundation 3 although typically at varying concrete depths 16 (not dimensioned) measured vertically relative to the surface 10 and at relative datum depth 19 measured vertically from the datum 11 down to the conduit 7. The conduit in FIG. 2 is shown at a relative datum distance 17 that is measured in a plane perpendicular to the section AA and through a vertical line. Collectively, the datum distance 17, datum distance 18 and datum depth 19 define what is typically called the X, Y, and Z coordinate position of the inside of the conduit inside the foundation 3 that can be measured at a time T. In order to increase the repeatability of the data readings taken it is proposed that the optimum conduit 7 shape is cylindrical so that the conduit readings can be intentionally taken at the center using centralizing devices as are known in other industries. However, other shapes are not eliminated from the scope of the present disclosure. One method for measuring the Z position from within the concrete 4 is by taking relative hydrostatic readings between a consistent datum elevation and the conduit 7 depth. It is necessary that the conduit 7 move along with the foundation so that movement of the conduit 7 also defines the movement of the foundation 3 over time. It is therefore preferred that the conduit be placed at a position so that the conduit remains inside of the concrete. As is common in the foundation industry, the conduit could be supported on standoffs (not shown) or "rebar chairs" or likewise pushed down below the upper surface 10 of the foundation 3 during the pour in the event that the conduit starts to float to the surface during concrete pouring as a result of relative buoyancy To offset the buoyancy of the conduit 7 during pour, it may be necessary to place anchors between the conduit and the supporting soil 20 that forms the lower bound of the foundation 3.

Figure 3:
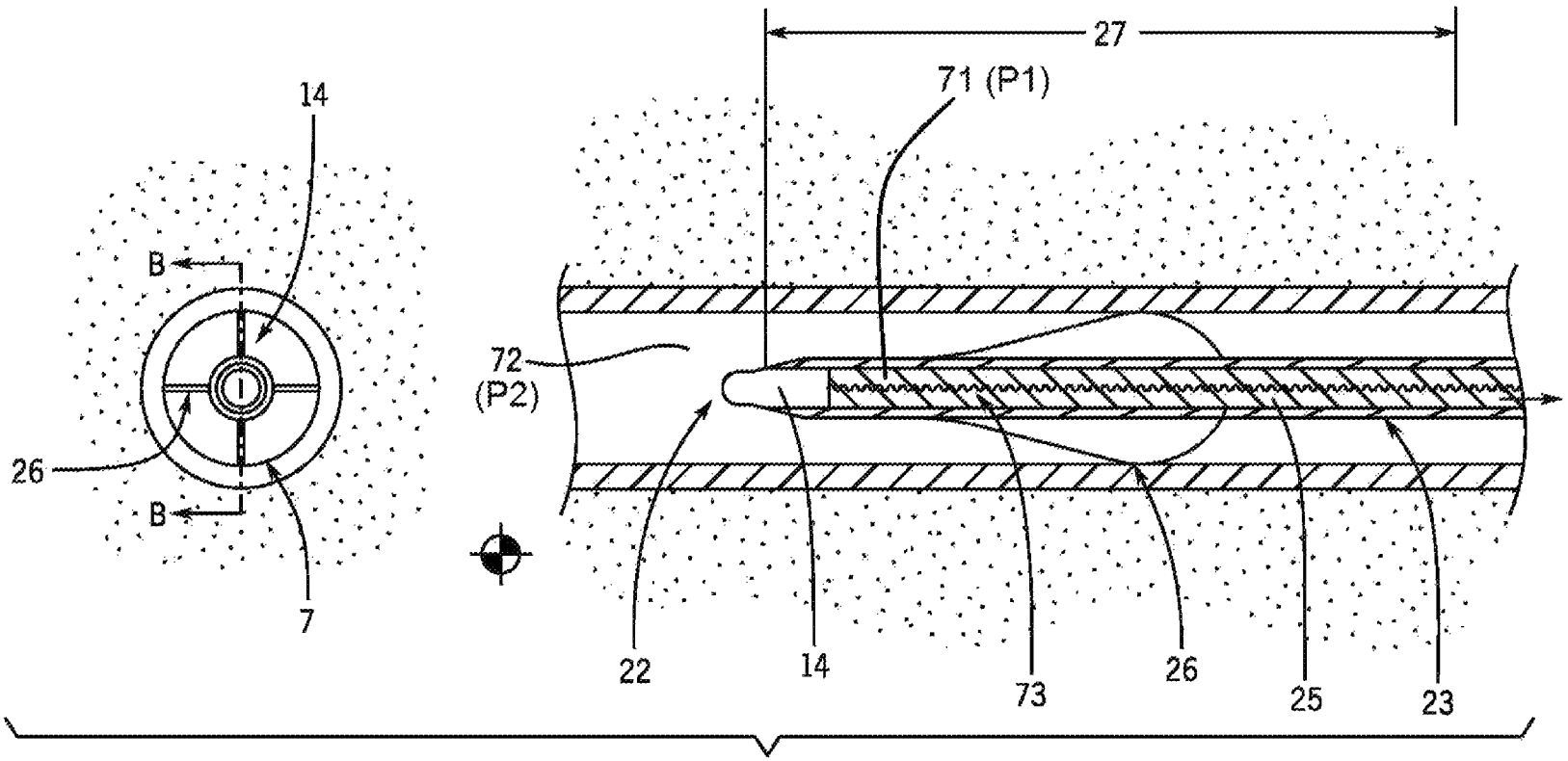
FIG. 3 is a sectional view of one embodiment of the measurement sensor inside of the conduit according to another embodiment of the present disclosure.

FIG. 3 depicts a close up section view of the conduit 7 illustrating a measurement sensor 14 inside the conduit 7 at section BB taken from the end view. The measurement sensor 14 shown has a pressure transmitting terminus 22 placed at the distal end of a fluid conduit 23 that is centralized in the conduit 7 by a centralizer 26. The terminus 22 provides a significant performance advantage over the prior art in remote pressure sensing by eliminating the need for any membrane. On the contrary, porosity of the terminus 22 does NOT prevent migration of fluid while the porosity of the terminus allows the hydrostatic air pressure to fully affect the pressure P on the fluid 25 on the distal end of the fluid conduit 23 inside of the conduit 7. The porosity of the terminus 22 thus removes the need for any gauges or transducers inside of the conduit 7 and the associated wiring that would need to be conveyed inside the conduit 7. Surface tension of the pressure sensing fluid 25 relative to the pore space in the terminus 22 allows the fluid 25 to remain inside of the fluid conduit 23. To maintain a consistent pressure reading over time, the use of anti-microbial agents may be required to be added to the fluid 25. The fluid conduit 23 is in fluid communication with the terminus 22 on one end and a fluid pressure sensor 24 (not shown) on the other that conveys the relative hydrostatic pressure P of the measurement sensor 14 at the elevation Z at some time T relative to the pressure of the fluid pressure sensor 24. By holding the elevation of the fluid pressure sensor 24 fixed during the time that the foundation 3 is inspected, the relative depth Z at any point along the conduit path 15 can be determined. If the X and Y coordinates are known for the conduit 7, then a complete X, Y, Z data set will be known at a time T. For each data point Z taken, the payout 27 can be recorded as well. The payout 27 is the total length of the fluid conduit 23 that is inside the conduit 7 that it cast in the foundation 3 through the point of entry 8. In order to reduce the error of the payout 27 and thus the error of the topographical data 12 acquired, the stretch of the fluid conduit 23 should be minimized. This can be achieved in multiple ways, but one economical method for doing so is through the addition of a sensor cable 73 inside of the fluid conduit 23. This can be a high tensile strength cable that still affords flexibility of the fluid conduit 23. Alternatively, sensor cable 73 could be integral to the fluid conduit 23 through an external braid. In one embodiment of the present disclosure, the sensor cable 73 could be mounted off center to the fluid conduit 23 so that twisting the fluid conduit 23 with the sensor cable 73 inside will cause the terminus 22 to twist and point in a controllable direction in a manner similar to a muscle contracting causes a finger to bend controllably.

In an alternative embodiment, the measuring sensor 14 which maintains conduit air pressure (P2) 72 on one end of the terminus and terminus fluid pressure (P1) 71 on the other may be connected to the fluid conduit 23 via a connection, not shown, such as a threaded connection, a quick disconnect, or other suitable method known by those skilled in the art. Likewise, a similar connection may be found to facilitate the joining of the fluid conduit 23 and the fluid pressure sensor 24, not shown. In yet another embodiment of the present disclosure, there may be a fluid barrier 70, not shown, or membrane such as a low density polyethylene or similar thin membrane between the fluid 25 at the terminus fluid pressure (P1) 71 and the conduit air pressure (P2) 72 on the other end of the membrane One skilled in the art of sensor design could ensure the fluid barrier was thin and flexible enough to ensure that the recorded values taken by the fluid pressure sensor 24 remain unaffected by the addition of this barrier.

As an alternative embodiment to the illustration depicted in FIG. 3, it is noted that there could be more than one centralizer 26 affixed to the measurement sensor 14 so as to improve the measuring sensor pressure P data quality which is converted into a depth Z. The result would be an improved alignment of the measuring sensor 14 centerline and the conduit 7 centerline. Another embodiment of the present disclosure would be to ensure that the fluid conduit 23 between the two centralizers 26 is a rigid member, although not too long as to impede movement through the bends in the conduit 7, to further enhance the measuring sensor pressure P data quality which is converted into a depth Z. In this configuration, the fluid conduit 23 and the sensor cable 73 will become combined into one member for at least a portion of the payout length and will yet again be better aligned to the conduit 7.

Figure 4:
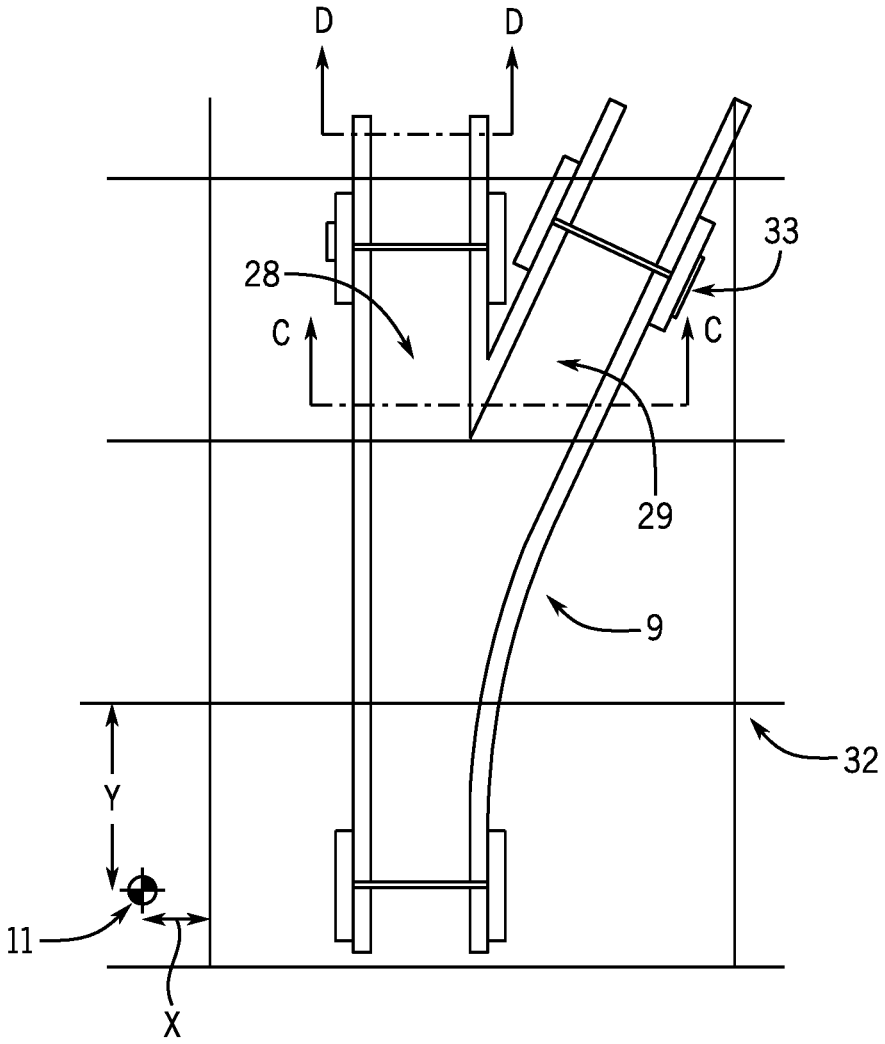
FIG. 4 is an illustration of a schematic diagram of one embodiment of the present disclosure depicting the acquisition of dimensional data about the conduit from an aerial (plan view) photograph in the vicinity of a junction.

FIG. 4 is an illustration of a plan view of one embodiment of this disclosure depicting the junction. It also depicts a reference grid for acquisition of three dimensional data along the conduit path from an aerial (plan view) photograph and elevation data. One of the advantages of the present disclosure over the prior art is the reduction in the number of points of entry 8 to the foundation 3. However, there are also complications to the foundation 3 that result directly from the reduction of the number of points of entry 8. For example, it is plausible that the entire foundation could be examined from one point of entry 8. However, this is expected to cause buckling of the fluid conduit 23 that will worsen with the length of the conduit 7. To reduce the total length of the fluid conduit 23 that has to be inserted into the foundation 3, the payout 27, this embodiment of the disclosure proposes to introduce a junction 9 into the foundation 3. There is no practical limit to how many junctions 9 can be placed in the foundation 3. Conversely, it is obvious to one skilled in the art of directional drilling how the design of the fluid conduit 23 could be optimized to reduce the chance of buckling by modifying the moment of inertia of the same.

By placing the junction 9 in the conduit 7, the payout 27 of two data points in the parent path 28 and lateral path 29 will have the same numerical value even though their actual X and Y coordinates will be different. For example, in FIG. 4, if the measuring sensor 14 were inside conduit 7 and one foot past the junction 9 inside the parent path 28 it could have the same payout 27 as if it were one foot past the junction 9 and in the lateral path 29. This means that the X and Y values associated with the payout 27 might have two distinct X and Y values relative to a reference grid 32. However, it is critical for the utility of present disclosure that the data set acquired inside of the conduit 7 always be discretely identifiable. There are multiple methods for differentiating the parent path 28 from the lateral path 29 that can be drawn from other industries such as directional drilling and horizontal drilling where the direction of the sensor can be noted so long as the tools are reduced in size in a manner suitable for the conduit 7 internal diameter. Likewise, a passive or active signal could be transmitted proximate the fluid pressure sensor 24 by one skilled in the art. This signal could be observed to determine if the P pressure reading and the corresponding Z value was taken in the parent path 28 or the lateral path 29. Alternatively, to know exactly what the corresponding X and Y coordinates are for any payout 27 and the recorded data points Z and P observed, the payout could be recorded until the pressure sensor 24 made contact with the open conduit terminus 30 and exited the foundation 3 or made contact with the closed conduit terminus 31 which could be observed through resistance at surface. The payout length 27 would be different in general for any two paths taken. However, in practice there could be two paths that appear to have the same payout length 27. Another method for distinguishing whether the measuring sensor 14 is in the parent path 28 or the lateral path 29 would be to place an identifier 33 in the parent path 28, lateral path 28 or both. Some examples or common identifiers include a radio frequency identification (RFID) tags (not shown), a mechanical perturbation (not shown), an electrical perturbation (not shown), a magnetic perturbation (not shown). These devices could create a unique signal when the measurement sensor 14 is uniquely inside of the parent path 28 or the lateral path 29. For example, a mechanical profile recess mounted in the conduit 7 could create one bump when in the measuring sensor 14 is inside parent path 28 or two bumps when inside the lateral path 29.

In order to allow the efficient acquisition of the topographical data 12 through the conduit 7 it is necessary to be able to selectively enter the parent path 28 or the lateral path 29 from the exterior of the foundation 3 through a simple translation of the fluid conduit 23. There are multiple industries where analogous solutions have been developed to solve this problem from the plumbing and other industries.

Figure 5A:
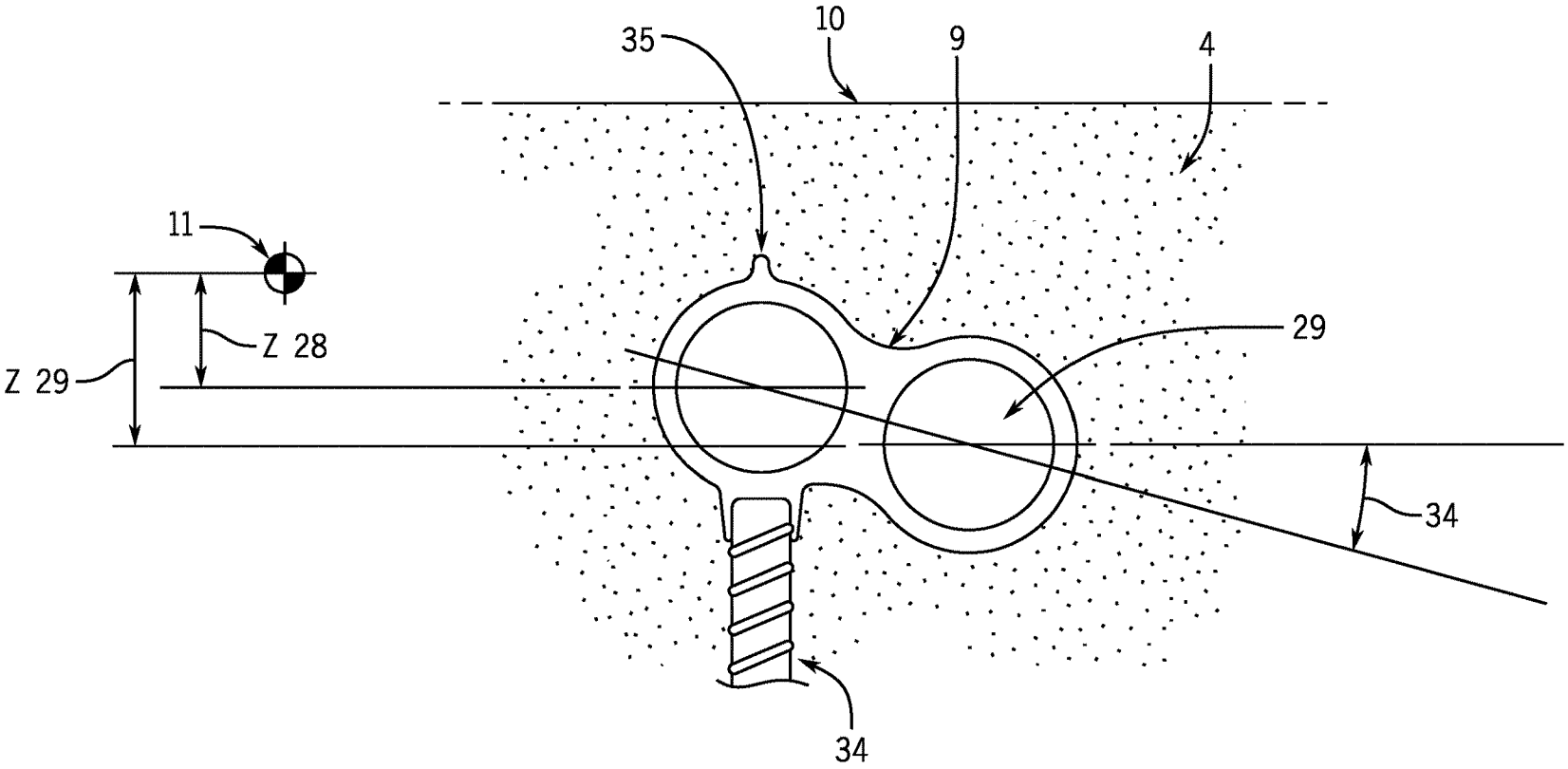
FIG. 5A is a sectional view taken from FIG. 4 of the junction depicting an embodiment of a junction in the present disclosure.

In the preferred embodiment of this disclosure, detailed in FIG. 5A, it is proposed that the vertical depth of the parent path and lateral path could be intentionally manipulated at the time that the junction 9 is installed and before the concrete 4 is poured to identify parent path 28 as distinct from the lateral path 29. By consistently orienting the elevation of the parent path 28 in a generally consistent depth (i.e. horizontal centerline) then the change in elevation pressure P measured by the measuring sensor 14 through the junction 9 will remain generally uniform. Similarly, by intentionally causing the lateral path 29 to deviate in elevation Z from the parent path 28 by placing it at a rotation angle 34 then the elevation Z recorded by the measurement sensor 14 will consistently be uniquely identifiable and distinct from the parent path 28. One immediate benefit from using elevation Z to identify whether the measuring sensor 14 is in the parent path 28 or the lateral path 29 is that no additional sensor is required. To put the disclosure into practice it is proposed that an index 35 be molded into the junction 9 to ease inspection for proper orientation prior to the pour of concrete 4 to form the foundation 3. Further, to aid in the speed of assembly and to provide support to the conduit 7, it is proposed that the junctions 9 be fitted with a post 36 whose lower end is anchored or inserted into the ground or another suitable and generally acceptable reference. This post 36 will aid in suspending the junction 9 at a practical and readily adjustable distance and may serve to reduce the variation of the elevation readings Z taken over time in the foundation 3. It could also serve to anchor the conduit 7 during the pouring of the concrete and prevent the conduit 7 from floating in the concrete slurry. Floating is likely as the conduit 7 will naturally have a lower bulk density than the concrete 4.

Figure 5B:
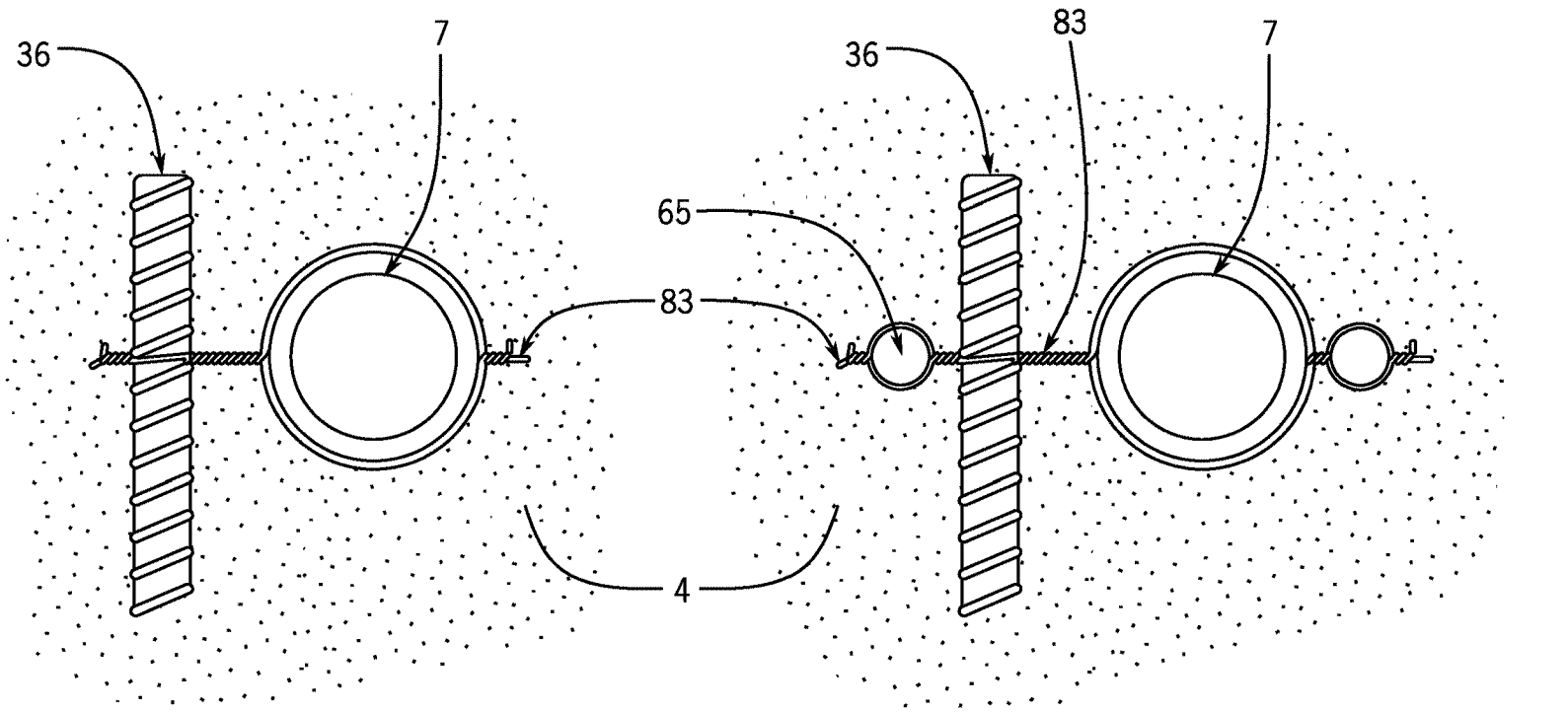
FIG. 5B is a sectional view taken from FIG. 4 of the conduit with two embodiments; one without reinforcement and one with a reinforcement placed proximate the conduit in the present disclosure.

FIG. 5B illustrates an embodiment of the present disclosure depicting a sectional view of the conduit in the foundation 3. To address the potential of conduit floating (or sinking) in the wet concrete, it is proposed that the conduit 7 be anchored with a post 36 which can tied to the conduit with conventional rebar ties 83. This is a very common practice in the construction industry where the post 36 is rebar or a saddle/chair. Further, there is a potential that the presence of the conduit 7, if of a sufficient diameter, in the foundation 3 could weaken the integrity of the foundation 3. It is known to those skilled in the art of foundation design that rebar will reinforce concrete. It is thus proposed that the preferred embodiment of the present disclosure would have a reinforcing member 65 such as rebar placed generally along the conduit 7 to offset any negative effect induced by the conduit 7 itself. Although the reinforcing member 65 is shown as rebar in FIG. 5B, it will be apparent to one skilled in the art of concrete reinforcement that the reinforcing member 65 could be incorporated into the conduit 7 itself either as a secondary element placed within the conduit material like braided wire or by making the conduit 7 a load carrying element with reinforcing properties like rebar and a hollow core. These products are currently commercially available and incorporated by reference. It is desirable that the reinforcing member 65 not be exposed to the elements since they are typically made of steel and as such will corrode over time. It may thus prove desirable to maintain the reinforcing member 65 as a separate element from the conduit so that it can remain fully buried in the concrete 4. In addition, since corrosion of the reinforcing member 65 over time is a concern, it is desired to have them in pairs on either side of the conduit 7. This will also provide a means for keeping the stress balanced on concrete 4 that is induced from having a weakening element in the concrete 4 like the conduit 7.

Figure 6A:
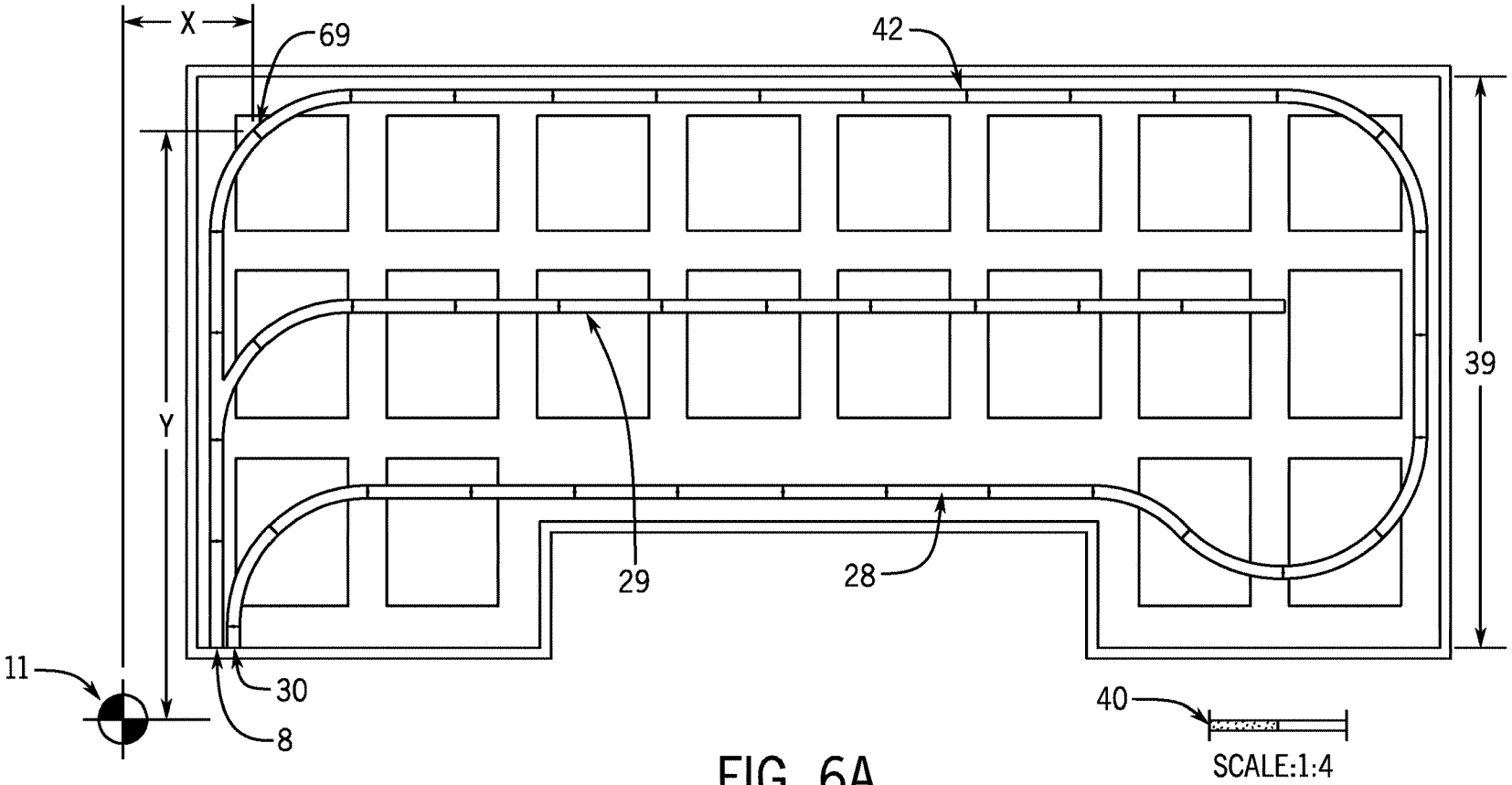
FIG. 6A is an illustration of a schematic diagram of an embodiment of the present disclosure showing the utilization of aerial photos to capture X and Y data.

The present disclosure relies on having the X, Y, and Z positions of discrete locations inside of the foundation at various points of time T so that the foundation topography can be mapped over time. FIG. 6A depicts the X and Y coordinates of a generic foundation where the depth Z and time T are implied as described earlier. Also described earlier are the means for determining if the measuring sensor is inside of the parent path 28 or the lateral path 29. One skilled in the art should be able to reduce the data collected to a charted map however, the X and Y coordinates are not explicitly known yet relative to any reference grid 32 as discussed and relating to FIG. 4. In order to determine the X and Y coordinates of the conduit, the present disclosure proposes that this can be done after the conduit 7 and junctions 9, if any, hereafter referred to as the conduit system 37, are placed in the forms 1 by use of an aerial photograph 38. It is important to note that said photograph 38 should be taken before the concrete 4 is poured and in a manner that allows the conduit system 37 to be visible. Although FIG. 6 is clearly not a photograph, one skilled in the art can see how a digital or other photograph 38 of sufficient elevation above the foundation 3 could be oriented to allow the forms 1 of the foundation 3 to create a reference X and Y axis system with a reference datum 1, which may be the same or discrete from the reference datum 1 mentioned in FIG. 1 above. One skilled in the art of surveying can resolve the translation or rotation as needed if the two should vary. With a photograph 38 and an X and Y axis defined, the scale 40 of the image needs to be determined. In the preferred embodiment, this is achieved by measuring the reference length 39 of a feature of the foundation 3 such as the length of an edge of the foundation 3. Alternatively, the reference length 39 can be read from the engineering print 41, not shown, for the foundation 3. Only one reference length 39 is needed although multiple readings may improve the accuracy of the scale slightly. As another alternative, the conduit 7 may be enhanced by having a length index 42 that is visible in the aerial photograph 38 which could determine the scale of the photograph. For example, the conduit could be mass produced to be PVC pipe that is white in color with a black stripe placed at one foot intervals, thus creating an easily identifiable length index. The necessity of recording a reference length 39 for the foundation is still preferred if the elevation Z is known to be constant and of appreciable length but one skilled in the art of surveying could also render a scale, depicted as 1:4 in the FIG. 6 from a length index 42 or a series of such marks. It is noted that when the scale 40 is resolved and the photograph 38 is rotated so that the X and Y axes are resolved so that a reference grid 32 can be placed on the photograph 38 that the aerial photograph can be used to determine the exact X and Y placement of any specific observation point in the conduit system 37 relative to a datum 1. Further, one skilled in the art of digitizing can create a discrete relationship between the X and Y coordinates in the photograph and the payout 27 of the measuring sensor 14 and the elevation Z recorded by the measuring sensor 14. In short, it is now clear how to record the topographical data 12 related to a foundation 3 by utilizing a conduit system 37 buried within the concrete 4.

Figure 6C:
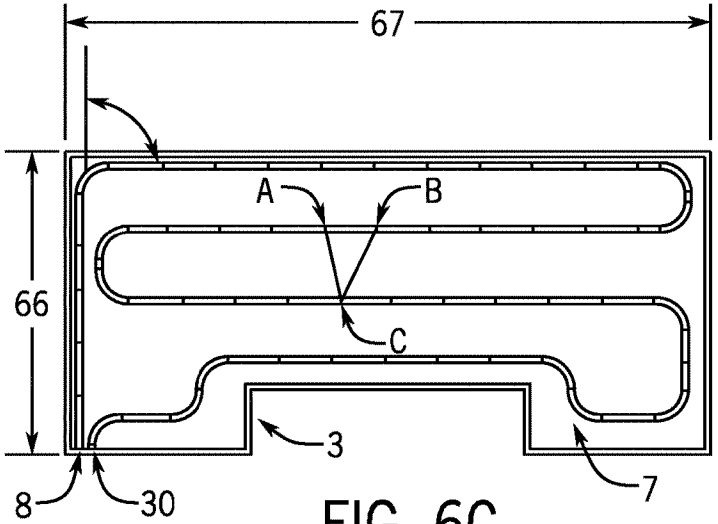
FIGS. 6B, 6C, and 6D are illustrations of schematic diagrams of alternative embodiments of conduit layout of the present disclosure.
Figure 6B:
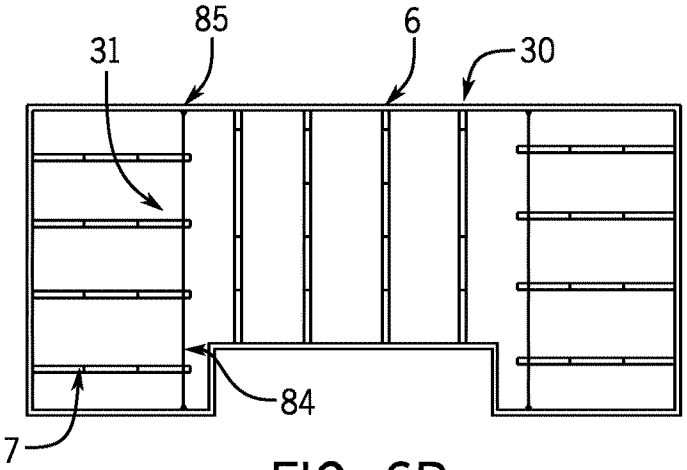

FIG. 6B shows another simplified embodiment of the present disclosure that shows an alternative approach to conduit 7 placement and foundation 3 inspection. Multiple points of entry 8 are required along the perimeter 2 to allow this design to be reduced to practice. It may prove beneficial to support the conduit 7 from the perimeter of the foundation 3 as it will be pulled down by gravity. This can be done utilizing the post 36 as described previously. Alternatively, a tether anchor 85 could be affixed to the inside of the forms 1 and a tether 84 pulled across the foundation which could be affixed to the conduit 7 with aforementioned rebar tie 83 (not shown) or similar approach. Although the length of each conduit 7 is shorter in this embodiment, this embodiment requires continued future access to all points of entry. This places restrictions on the future modifications that may be made to the structure resting on the foundation 3. On foundations 3 that share a property boundary or nearly share a property boundary, this approach has significant future limitations as well. Also shown in FIG. 6B are conduit 7 sections which span the foundation 3 from end to end. This approach has advantages in that the fluid conduit 23 needed to inspect the foundation is shorter and less likely to exhibit buckling although there are more points of entry 8 that require installation and maintenance.

FIG. 6C depicts another embodiment of the present disclosure. The foundation 3 is again fitted with conduit 7 designed to measure the elevation of the foundation 3 over time T. The foundation 3 can be described in a manner that generally has a length 66 and a width 67 although one familiar with foundations will readily admit that this will not describe all foundations or shapes. None-the-less the conduit 7 path described in FIG. 6C does not take a generally straight path across the foundation 3 as was the case for the conduit 7 in FIG. 6B. Instead, the conduit 7 in FIG. 6*c* deviates from the most direct route by the angle of departure 68 shown. Further, the conduit 7 continues to turn with multiple angles of departure 68 until the open conduit terminus 30 is proximate the point of entry 8. In this manner, it is apparent that the payout 27 required to span the conduit 7 from the point of entry 8 to the open conduit terminus 30 will be longer than the length 66. Similarly, it is apparent that the payout 27 required to span the conduit 7 from the point of entry 8 to the open conduit terminus 30 will be longer than the width 67. In the previous examples it should be noted that the same is true for a conduit 7 that has an open conduit terminus 30. Said another way, the conduit 7 is placed in a foundation 3 with the express purpose of capturing a series of observation points 69 to yield a contour plot 56 (see FIG. 7 A-C). Contour plots are created via repeated triangulation between observation points 69. FIG. 6C has three specific observation points 69 labeled as point A, B, and C. When the conduit 7 remains generally straight (the angle of departure 68 is low) then a plurality of conduits 7 are required to create multiple observation points 69 for the aforementioned triangulation to occur. This means that the perimeter 2 of a foundation 3 will have multiple points of entry 8 relative to observation points 69. When the conduit 7 is not generally straight, but exhibits a high angle of departure 68 as depicted in the figures then it becomes possible for the observation points A, B, and C to form an acute triangle where all three sides (AB, BC, and AC) can be used to interpolate the elevation reading used to create the contour plots. Thus, the conduit path 15 from observation point A to observation point C (which itself contains multiple observation points 69 in between) will be longer than the side of the triangle side AC which is defined as the straight line between observation point A and observation point C. Thus, it is observed that interpolation of elevation data between observation points 69 that are not adjacent to one another but still from the same conduit 7 will yield better interpretation of the elevation change of the foundation 3 without the addition of an additional point of entry 8 in the foundation 3. It should be noted that this is not just an advantage when the triangle ABC is and acute triangle. Any time that the conduit becomes non-linear, it becomes possible to interpolate data in a similar manner even if the triangle is obtuse and sum of the longest side of the triangle is very nearly the sum of the other two as is the case when the angle of departure 68 is only a few degrees. It should further be noted that there is no requirement to triangulate the data points. Interpolation or extrapolation whether done in an objective, subjective manner, programmatical or similar manner shall be interpreted as just another means for determining the contour plots.

Figure 6D:
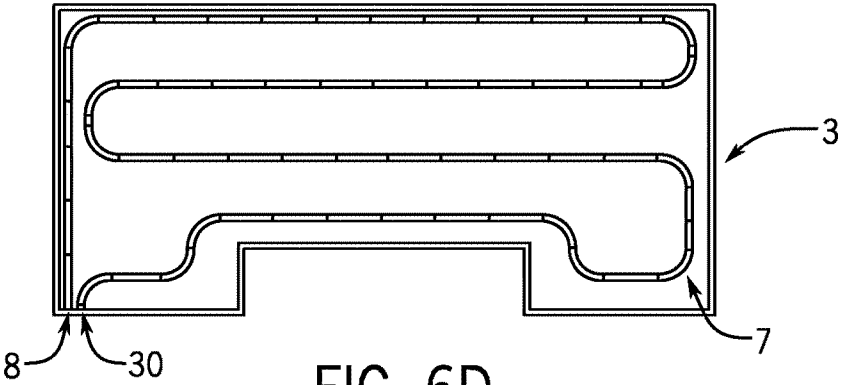

FIG. 6D depicts yet another embodiment of the present disclosure where the conduit 7 is "wrapped" back and forth throughout the foundation 3 with multiple angles of departure (not shown) again being greater than zero. The benefit of this embodiment is that there is only one point of entry 8 and one open conduit terminus 30 which makes inspection simple. It is repeated for emphasis that the point of entry 8 and open conduit terminus 30 can be reversed in function to where the measuring sensor 14 enters through the opposite end, both ends or even two sensors enter both ends simultaneously or otherwise. However, the longer the fluid conduit 23, the harder it will be to push the fluid pressure sensor 24 forward. The potential limitation of this approach is that frictional drag between the fluid conduit 23 and conduit 7 could become large enough to cause the fluid conduit 23 to buckle inside the conduit 7. One simple solution would be to a apply pressure to the inside of the fluid conduit to stiffen it. Another alternative is to take elevation readings while withdrawing the measurement sensor 14 so that the fluid conduit 23 remains in tension instead of during insertion where the fluid conduit 23 is in compression. The measurement sensor 14 and fluid conduit 23 could further be pulled through the foundation 3 by first blowing a dart (not shown) on a string (not shown) through the conduit 7 and then pulling the measurement sensor 14 and fluid conduit 23 through the conduit 7 with said string. (This practice is common when running electrical wires through electrical conduit.) Upon examining FIGS. 6A, 6B, 6C, and 6D, it is apparent that the perimeter 2 in FIG. 6B will potentially not remain accessible for the duration of the foundation since any additions to the foundation could block one or more points of entry 8. Since the data cannot be captured if any point of entry 8 becomes blocked, the remaining conduit 7 designs (FIGS. 6A, 6C, and 6D) offer a long term advantage in that they can generally be altered along the perimeter 2 without affecting the ability take future elevation readings. Another simple yet important advantage of the alternative configurations proposed in FIGS. 6A, 6C, and 6D over FIG. 6B is that placing the point of entry 8 in a preferred location with public access makes access to the point of entry much simpler for technicians. For example, having certain points of entry in the back yard of a residence could expose measurement personnel to hostile pets or locked gates and a host of other complications known to those in the utility meter reading industry. Each of the foundations shown in FIGS. 6A, 6C, and 6D exhibits a conduit path 15 that exhibits an angle of departure 68 that is greater than at least 10 degrees along the conduit path 15.

Figure 7A:
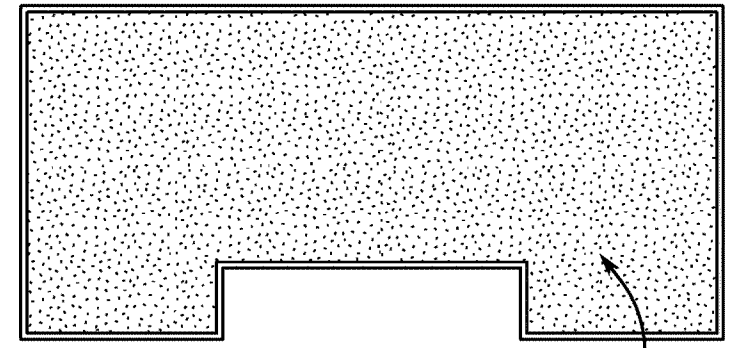
FIGS. 7A-7C are illustrations of four dimensional data acquisition by adding the time element and elevation mapping in one embodiment of the present disclosure.
Figure 7B:
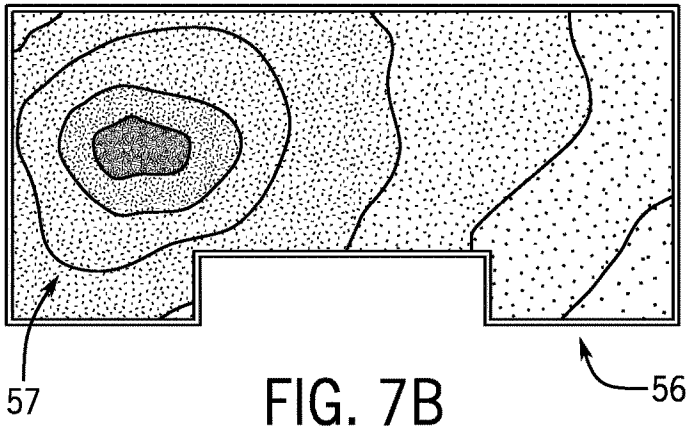
Figure 7C:
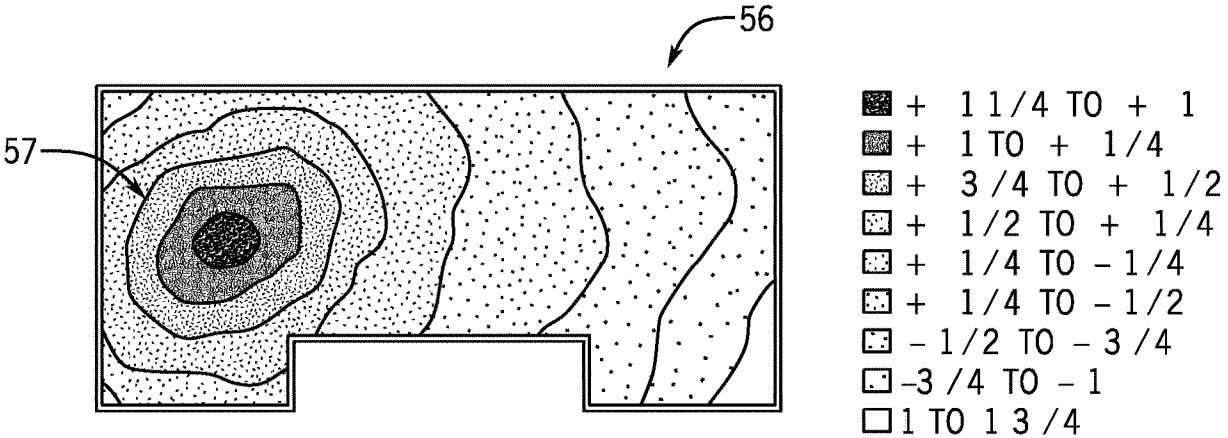

FIGS. 7A, 7B, and 7C depict a simplified embodiment of contour plots 56 of a foundation 3 at various points in time T. These figures are intended to correspond to the partial data set provided in FIGS. 9A, 9B and 9C. In FIG. 7A, the depicted time is the time of the initial reading (time=0). Even though the actual topographical data 12 acquired at time zero will include a series of pressure readings (P) and their corresponding datum depth (Z) that will be varied in value, the topographical data 12 represents a reference for future use and a set of data where the foundation was inspected and deemed acceptable for service. As an example, FIG. 9A shows that at time T=0 yrs when the measuring sensor 14 was inside conduit 7 with a payout reading of 12.0 ft, the X and Y value of the measuring sensor was 6.12 ft and 9.34 ft respectively. The X and Y value were determined from the engineering print 41 or from and aerial photograph 38 in the preferred embodiment. At this initial time, the measuring sensor pressure 24 recorded a pressure of −0.0411 psi which is converted to a datum depth 19 of −1.139 inches relative to the datum 11. The next time that the measuring sensor 14 is inside conduit 7 with a payout reading of 12.0 ft, the pressure reading of the measuring sensor pressure 24 can be converted to a datum depth 19 again and a determination can be made if the conduit 7 and thus the foundation 3 has risen or fallen and exactly how much. Therefore, even though the surface of the foundation is generally not truly flat due to the methods used to spread the concrete during construction, the topographical data set 12 can completely define the initial state of the foundation. Thus this data set of X, Y, Z, and T data points measured along the entire conduit system 37 is used as the baseline data set and the elevation values are marked as zero inches over the entire surface. All future elevation readings will thus become relative elevation readings along the same conduit system 37. It will be apparent to one skilled in the art of construction that having the data captured below the concrete surface 10 has particular value when locations of walls, cabinets, flooring and other common features that limit the access to the concrete surface 10 after the concrete 4 is poured.

FIG. 7B represents contour plot 56 of the same representative foundation 3 shown in FIG. 7A created at a time 2.1 years later in time. The contour map is created from a series of data points (again with a corresponding partial sample shown in FIG. 9B) taken through the same conduit 7 as at time t=0 and therefore the datum distance 18 (x) and datum distance 17 (y) will remain the same. Since the conduit 7 is cast in the concrete with tensile members present, with the only variable is the pressure reading (P) and the corresponding datum depth 19 (z). So long as the concrete foundation contains sufficient tensile stiffeners, then the conduit path 15 does not change over time in the X and Y orientation. This means that the relative change in elevation of the conduit system 37 and the foundation 3 are known precisely and the change in elevation can be plotted as a series of contour plots depicted in FIG. 7*b*. For example, the data in FIG. 9B shows that at time T=2.1 years when the measuring sensor 14 was again inside conduit 7 with a payout reading of 12.0 ft, the X and Y value of the measuring sensor was still 6.12 ft and 9.34 ft respectively. The X and Y value were stored in a database for direct conversion from the payout readings. At this new time, the measuring sensor pressure 24 recorded a pressure of −0.0415 psi which is converted to a datum depth 19 of −1.150 inches relative to the datum 11 which corresponds to a very slight change of just −0.011 inches deeper position relative to the original data set in FIG. 9A. One skilled in the art of pressure data acquisition will realize that there may be a bulk offset applied between the reference datum from the initial time and the second time. Further, one skilled in the art of contour plotting could realize the datum 11 in the Z direction could be an average elevation reading to account for slab tilt. This averaging of the data could result in an additive, subtractive or other mathematical correction to the vertical data.

FIG. 7C represents a contour plot 56 created from a topographical data set 12 at a point of time (e.g. moment in time) that is still later, in this case 4.3 years after the initial data set. This topographical data set 12 can be used to create a contour plot 56 with isobar 57 lines representing the total rise of fall of the foundation relative to the initial readings taken at time=0 shown in FIG. 7A. Likewise, the contour plot could also represent the relative change in elevation since another point in time like the time shown in FIG. 7*b*. For example, the data in FIG. 9C shows that at time T=4.3 years when the measuring sensor 14 was again inside conduit 7 with a payout reading of 12.0 ft, the X and Y value of the measuring sensor was still 6.12 ft and 9.34 ft respectively. At this new time, the measuring sensor pressure 24 recorded a pressure of −0.0411 psi which is converted to a datum depth 19 of −1.139 inches relative to the datum 11 which corresponds to a very slight change of just +0.011 inches relative to the previous recording at 2.1 years shown in FIG. 9B and equal to the elevation in the original data set in FIG. 9A. With any two or more topographical data sets 12 taken at separate points in time a rate of change calculation can be made and predictions about future positions can be forecast. This has not been disclosed in detail here as this should be apparent to one skilled in the art. Therefore, FIG. 7C could be a predicted contour plot that represents the contour plot that is anticipated based on previous recorded data about the specific foundation. This forecasting of future values can be linear or nonlinear as the mathematical models dictate.

Figure 8B:
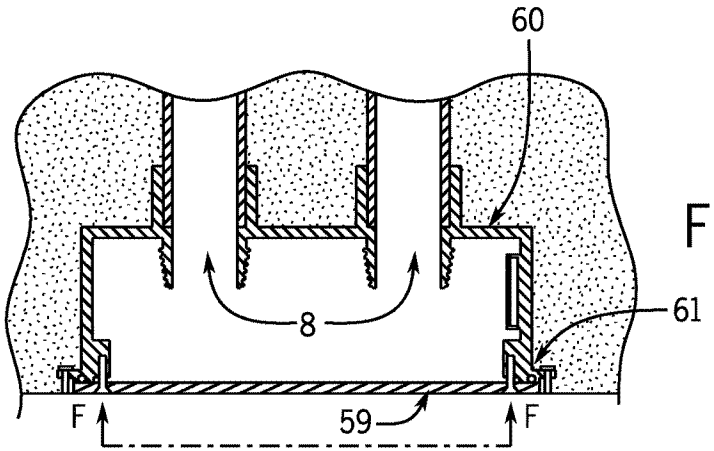
FIGS. 8A-8C depict a simplified schematic diagram of one embodiment of the point of entry and entry cap of the present disclosure.
Figure 8C:
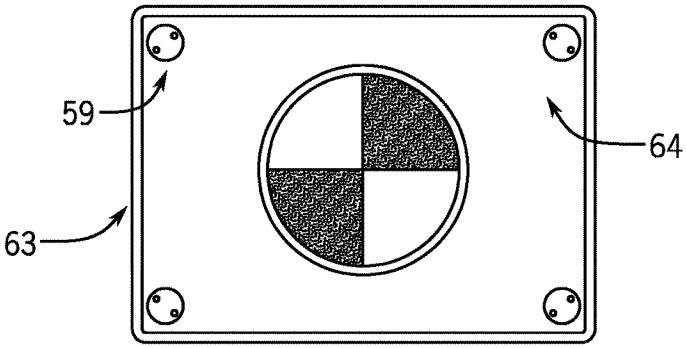
Figure 8A:
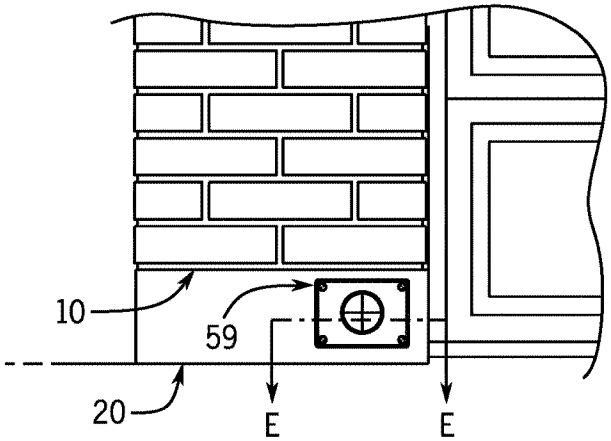

FIGS. 8A-8C depict a simplified embodiment of this disclosure indicating the preferred single point of entry 8 along the perimeter 2 of the foundation 3. The preferred embodiment of the present disclosure has an entry cap 59 that would allow all interested parties to identify the presence of the topographical data 12 of the foundation 3. To that end, the entry cap 59 is intended to be highly visible and distinct and consistently placed to allow for easy identification by interested parties. For example, in the southern United States, it is very common to have one or more garages. More and more, the garages are becoming attached to the main structure. It is proposed that the entry cap 59 be fitted with a clearly identifiable logo and routinely placed proximate the garage door as shown in FIG. 8A. One skilled in the art of designing a slab on grade foundation 3 will recognize that a properly designed and installed foundation 3 will have a gap between the soil 20 and the foundation surface 10 that supports the brick or outer veneer to prevent moisture ingress into the structure. For ease of identification, it is thus proposed that placing the point of entry 8 to the foundation 3 in a consistent location will prevent needless searching for the point of entry 8 and thus has immediate value as well. In the northern United States, or facilities where a garage is not present or detached from the main structure, the point of entry 8 should be placed proximate the main entry (not shown) to the finished edifice (not shown) for the same reasons. The point of entry 8 should be sealed and covered to prevent entry by unwanted persons or deleterious matter. There are multiple ways to achieve this by one skilled in the art. One proposed approach is to have the point of entry 8 covered with an entry cap 59 that can be affixed to a cap seat 60 that is cast into the concrete 4 during the pouring of the concrete 4. As an alternate embodiment, the cap seat could be threaded itself. If so, one skilled in the design of caps would recognize that the thread should be course and forgiving, like a stub acme thread. To reduce the biological matter entry, the entry cap 59 and entry seat 60 could be fitted with a cap seal 61. In order to reduce unwanted persons from entering, the entry cap 59 cap seat 60 interface could be fitted with a lock (not shown). One skilled in the art would recognize multiple mechanisms for a lock that could reduce tampering or vandalism; magnetic lock, key, dowel, j-lock, false bottom, tamper evident device as used on utility boxes, and many others. It is proposed that the entry cap 59 be fitted with both generic markings 63 information such as company name, central contact phone number, and company website as well as serial/unique ID 64 information.

Figure 8:
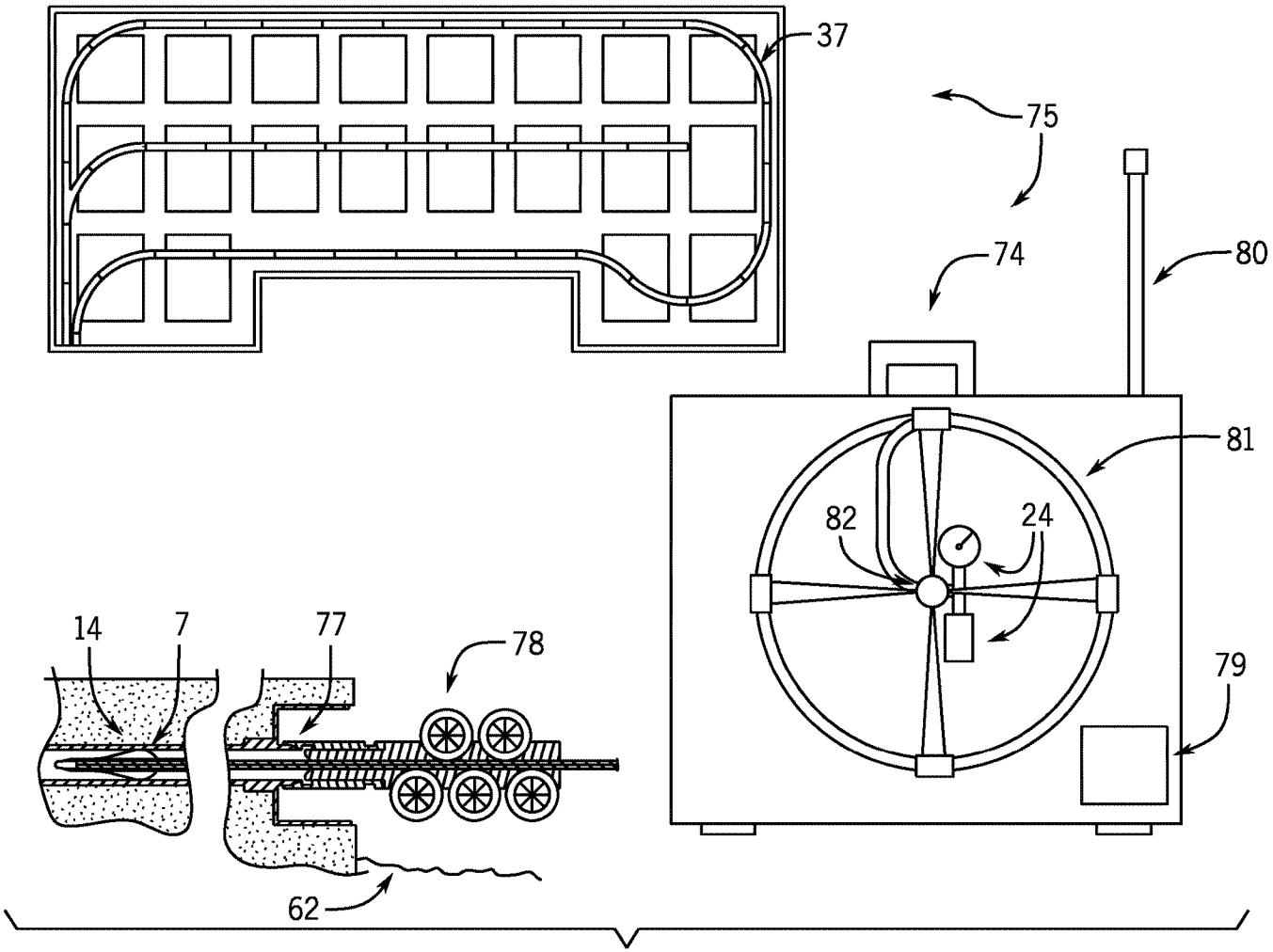

FIG. 8, depicts the preferred embodiment of apparatus of the current disclosure, which combines the proposed elements needed to measure a foundation 3 over time T and fully document the precise movement of a foundation 3, provide clarity in assessing any need to correct foundation movement and independently assess corrections made to the foundations as well as their long term success. An embodiment of a measuring device 74, may include: the measurement sensor 14, fluid conduit 23, fluid 25, and fluid pressure sensor 24. When the measuring device 74 is combined with an embodiment of a conduit system 37 then it becomes an embodiment of a measurement system 75 which encompasses the basic components needed to measure a foundation over time. However, there are alternative embodiments of this measurement device 74 that will make it easier to use and thus preferred. One improvement could be a docking feature 77 where the payout 27 of the sensor has a consistent reference point by virtue of screwing a payout control 78 onto the point of entry 8 via the aforementioned docking feature 77. It is proposed that the payout control 78 could have a friction drive to push or pull the fluid conduit 23 through the conduit 7 placed in the foundation 3 as needed to record the needed X, Y, and Z data recordings at time T. In order to push or pull the fluid conduit 23, the preferred embodiment would have a solid reference to push against. The docking feature 77, by virtue of the threads can provide this solid reference. It is further proposed that the friction drive in the payout control 78 could have feedback mechanism like an optical rotary encoder (not shown) that could record the payout 27 directly. These mechanisms are common in field of automation. The preferred embodiment is proposed to likewise have a reel 81 that is designed to capture and store the fluid conduit 23 when it is removed from the foundation 3. At the center of the reel 81 it is proposed to place a rotary union 82 that allows the reel to rotate while the fluid pressure sensor 24 remains stationary. In the preferred embodiment, it is proposed that an analog fluid pressure sensor 24 and a digital pressure sensor 24 could both be utilized. However, automation will be easier to achieve with a digital fluid pressure sensor 24. One skilled in the art of automation could readily find alternative solutions that perform in a like manner. The preferred embodiment utilizes a pressure transducer that has a range of approximately one foot and an accuracy of approximately 1/32" or less. The preferred embodiment of the measuring device 74 is portable as shown in FIG. 9 where it is encased in a portable case as shown. It is proposed that the preferred embodiment will have a controller 79 that records the payout 27 from the payout control 78, time T from the controller's internal clock, and pressure P as recorded from the fluid pressure sensor 24. Alternatively, the force applied to push or pull the fluid conduit 23 and measurement sensor 14 through the conduit 7 could be measured directly or interpreted from motor current reading on the payout control 78.

The preferred embodiment would have the data captured by the controller 79 displayed (as displayed in FIGS. 9A, 9B, and 9C, or FIG. 7A, 7B, or 7C) in real time via the internet as conveyed via an antenna 80. It is possible to achieve this in a number of ways as will be apparent to one skilled in the art of real time data transmission. It will be apparent to one skilled in the art of data capture that the data captured on the fluid pressure sensor 24 will react to motion of the fluid conduit 23 as induced by the payout control 78. In the preferred embodiment, the pressure P recorded tends to lag behind the payout 27 but both reach steady state relatively quickly. Once the pressure P stops changing, the pressure can be recorded by the controller 79. Depending on the pressure transducer, the pressure P recorded is converted into a Z value in inches at a corresponding payout 27 as previously discussed. Further, from the previously loaded digitized X and Y coordinates of the conduit 7 via all of the observation points 69, the payout 27 value recorded is automatically converted into X, Y, and Z values and stored in a file for future use as previously discussed.

This application is related to, and claims the benefit of, U.S. Provisional Application No. 62/406,946 titled METHOD AND APPARATUS FOR KEEPING FOUNDATIONS FLAT, filed Oct. 12, 2016, and U.S. Provisional Application No. 62/406,950, titled SYSTEMS AND METHODS FOR DATA TRACKING TO ENHANCE FOUNDATIONS, filed Oct. 12, 2016, each of which is incorporated herein in its entirety by reference.

Although other versions of measuring foundation movement are practical, like fiber optic measurements, the present disclosure describes a simpler solution and one that does not rely on interpretation of data but instead relies on direct measurement.

The invention claimed is:

1. A method of determining relative foundation movement, the method comprising: recording a plurality of data points over a plurality of moments in time with one or more sensors when each of the one or more sensors is positioned within an outer perimeter of a concrete foundation, the one or more sensors being positioned to extend into an external opening defining an entry point of a conduit path, the conduit path being anchored to and positioned to extend into and through at least portions of the concrete foundation, the conduit path also having a closed terminus and an open terminus.

2. The method of claim 1, wherein the plurality of data points comprise a first plurality of data points, the first plurality of data points being recorded at a first moment in time, wherein a second plurality of data points is recorded at a second moment in time to establish a second condition of the foundation, and wherein one or more portions of the conduit path in which the one or more sensors are positioned are identified responsive to the plurality of data points.

3. The method of claim 2, wherein the time between the first and second plurality of recorded data points is at least one week, wherein the conduit path is positioned in the concrete foundation when concrete material of the concrete foundation is poured, and wherein the conduit path is positioned in one or more beams of the concrete material of the concrete foundation and adjacent the one or more beams of the concrete material.

4. The method of claim 2, wherein one or more sensors comprise at least one moveable sensor having a payout, the method further comprising inserting the at least one moveable sensor into the entry point of the conduit path, wherein the sum of the length of the at least one moveable sensor payout is longer than either a width of the foundation, a length of the foundation, or both, and wherein the conduit path has a preselected angle of departure between a first portion of the conduit path defining a first leg and a second portion of the conduit path defining a second leg.

5. The method of claim 4, wherein the at least one moveable sensor of the one or ore sensors positioned in the conduit path senses the plurality of data so as to provide at least three dimensions, and wherein at least of one of the at least three dimensions includes an elevation after insertion of the moveable sensor into the entry point of the conduit path.

6. The method of claim 4, wherein three or more data points of the plurality of data points recorded by the at least one moveable sensor when positioned in the conduit path during a plurality of moments in time so that locations of the three or more data points define at least one triangle with lengths of each leg of the at least one triangle being one foot or more.

7. The method of claim 1, wherein the plurality of data points is converted into an image that represents a change, over a period of time, in elevation of one or more of: (a) the conduit path, and (b) the foundation; and wherein one or more depths of the conduit path is measured relative to one or more datum.

8. The method of claim 1, wherein the inside diameter of the conduit path is 4 inches or less.

9. The method of claim 1, further comprising determining a rate of movement of the foundation and estimating future movement of at least a portion of the foundation, and wherein the estimating includes use of the rate of movement and the plurality of data points.

10. An apparatus for measuring relative foundation movement, the apparatus comprising:

an entry point to a concrete foundation;

a conduit path connected to the entry point, disposed within an outer perimeter of and anchored to the concrete foundation, and having a closed terminus and an open terminus;

a moveable sensor positioned in the conduit path;

a data recorder positioned to record responsive to the moveable sensor:

(a) a plurality of data points in at least a vertical direction to represent the conduit path at a first moment in time, (b) a second plurality of data points in at least the vertical direction to represent the conduit path at a second moment in time, a comparator to compare the relative vertical movement of the conduit path at the first and second moments in time; and a determiner to determine one or more of: (a) relative movement of at least a portion of the foundation, and (b) rate of movement of at least a portion of the foundation.

11. The apparatus of claim 10, wherein a vertical component of the conduit path geometry is determined by measuring a pressure difference between a point at a known location disposed within the aforementioned conduit path relative to the pressure of a fluidly coupled reference datum.

12. The apparatus of claim 10, wherein the moveable sensor includes an elevations sensitive device, and wherein a vertical geometry of the conduit path is determined by manipulating the elevation sensitive device internal to the conduit path via the point of entry at a generally known payout distance.

13. The apparatus of claim 12, wherein the horizontal geometry of the conduit path is measured prior to the pouring of the concrete foundation, and wherein the conduit path is positioned in a preselected location of the concrete foundation when pouring of the concrete occurs.

14. The apparatus of claim 10, wherein the conduit is positioned adjacent a beam within a perimeter of the foundation such that changes in the conduit path correlate strongly to changes in the foundation after concrete solidification.

15. The apparatus of claim 14, wherein the correlation is achieved through a reinforcing element in the concrete.

16. The apparatus of claim 14, wherein the conduit is placed at least partially near a structural beam of the foundation, and wherein the conduit comprises a load carrying element and has a hollow core.

17. The apparatus of claim 14, wherein the conduit path remains within about six inches of the neutral axis of at least one structural beam of the foundation for at least five feet measured in a generally horizontal direction.

18. The apparatus of claim 14, wherein the foundation contains at least one tensile stiffener and one conduit path.

19. The apparatus of claim 18, wherein the one or more conduit paths includes an entry point positioned to prevent unwanted entry of deleterious matter when positioned in a publicly accessible location.

20. The apparatus of claim 10, wherein any two data points are less than 30 feet apart, wherein an interior of the conduit path is substantially dry, and wherein the conduit includes a closed concrete terminus.

21. The apparatus of claim 10, wherein the conduit path exhibits an angle of departure exceeding 10 degrees.

22. The apparatus of claim 10, wherein the conduit diameter is less than four inches.

23. An apparatus for internal elevation measurement of a foundation of a structure, the apparatus comprising:

one or more conduit paths attached to one or more points of entry of a concrete foundation, positioned adjacent a beam of the concrete foundation, and having a closed terminus and an open terminus; and one or more pressure-responsive elements positioned within the conduit path at a determinate location.

24. The apparatus of claim 23, wherein the one or more pressure-responsive elements includes a pressure sensor capable of interpreting the relative elevation change between one location within a perimeter of the foundation and a reference datum elevation.

25. The apparatus of claim 24, wherein the one location within the foundation and the reference datum elevation are fluidly coupled with a fluid capable of conveying relative pressure, and wherein the one or more conduit paths of the apparatus comprises a fluid conduit capable of isolating fluid on one side relative to the other.

26. The apparatus of claim 25, wherein the pressure responsive element is positioned in a substantially dry conduit positioned in the foundation and is mechanically linked to a reference datum in a generally horizontal plane and linked to a generally vertical reference datum, and wherein the mechanically linking defines a mechanical linkage connected to the pressure responsive element and at least partially comprises the same component.

* * * * *